US008101291B2

(12) United States Patent
Åkesson et al.

(10) Patent No.: US 8,101,291 B2
(45) Date of Patent: Jan. 24, 2012

(54) COATED CEMENTED CARBIDE INSERT PARTICULARLY USEFUL FOR HEAVY DUTY OPERATIONS

(75) Inventors: Leif Åkesson, Älvjö (SE); Kenneth Westergren, Hägersten (SE)

(73) Assignee: Sandvik Intellectual Property AB, Sandviken (SE)

( * ) Notice: Subject to any disclaimer, the term of this patent is extended or adjusted under 35 U.S.C. 154(b) by 537 days.

(21) Appl. No.: 12/003,372

(22) Filed: Dec. 21, 2007

(65) Prior Publication Data

US 2008/0166192 A1 Jul. 10, 2008

(30) Foreign Application Priority Data

Dec. 27, 2006 (SE) ..... 0602815

(51) Int. Cl.
*B32B 9/00* (2006.01)

(52) U.S. Cl. ..... 428/698; 51/307; 51/309; 407/119; 428/216; 428/325; 428/336; 428/701; 428/702

(58) Field of Classification Search ..... 51/307, 51/309; 428/216, 325, 336, 698, 701, 702; 407/119
See application file for complete search history.

(56) References Cited

U.S. PATENT DOCUMENTS

| | | | | |
|---|---|---|---|---|
| 4,277,283 | A | 7/1981 | Tobioka et al. | |
| 4,610,931 | A | 9/1986 | Nemeth et al. | |
| 4,830,283 | A | 5/1989 | Johnson | |
| 4,830,930 | A | 5/1989 | Taniguchi et al. | |
| 5,106,674 | A | 4/1992 | Okada et al. | |
| 5,310,605 | A | 5/1994 | Baldoni, II et al. | |
| 5,451,469 | A * | 9/1995 | Gustafson et al. | 428/548 |
| 5,494,635 | A * | 2/1996 | Bennett | 419/14 |
| 5,649,279 | A * | 7/1997 | Gustafson et al. | 419/25 |
| 5,729,823 | A * | 3/1998 | Gustafson et al. | 51/307 |
| 5,861,210 | A * | 1/1999 | Lenander et al. | 51/309 |
| 5,863,640 | A * | 1/1999 | Ljungberg et al. | 428/701 |
| 6,221,479 | B1 * | 4/2001 | Waldenstrom et al. | 428/325 |
| 6,294,129 | B1 | 9/2001 | Waldenström | |
| 6,299,992 | B1 | 10/2001 | Lindskog et al. | |
| 6,333,100 | B1 * | 12/2001 | Palmqvist et al. | 428/325 |
| 6,344,264 | B1 * | 2/2002 | Lenander et al. | 428/325 |
| 6,344,265 | B1 * | 2/2002 | Blomstedt et al. | 428/216 |
| 6,468,680 | B1 * | 10/2002 | Waldenstrom et al. | 428/698 |
| 6,554,548 | B1 | 4/2003 | Grab et al. | |
| 6,692,822 | B2 * | 2/2004 | Andersson et al. | 428/336 |
| 7,135,221 | B2 * | 11/2006 | Ruppi et al. | 428/216 |
| 7,192,637 | B2 * | 3/2007 | Ruppu et al. | 428/702 |
| 7,727,621 | B2 * | 6/2010 | Nordlof et al. | 428/216 |
| 2006/0019117 | A1 | 1/2006 | Cedergren et al. | |

FOREIGN PATENT DOCUMENTS

| | | |
|---|---|---|
| EP | 0 629 713 | 5/1994 |
| EP | 0 603 143 | 2/2000 |
| EP | 0 737 756 | 7/2002 |
| JP | 6-228700 | 8/1994 |
| JP | 2000-204424 | 7/2000 |
| JP | 2001-502249 | 2/2001 |
| JP | 2002-520484 | 7/2002 |
| JP | 2004-510589 | 4/2004 |
| WO | WO 98/16665 | 4/1998 |
| WO | 00/03048 | 1/2000 |

OTHER PUBLICATIONS

Chinese Office Action issued in Chinese Application No. 200710305901.1 issued Aug. 27, 2010 (with translation).
Notice of Reasons for Rejection issued by the Japanese Patent Office in Japanese Application No. 2007-334659 mailed Jan. 4, 2011.

* cited by examiner

*Primary Examiner* — Archene Turner
(74) *Attorney, Agent, or Firm* — Morgan, Lewis & Bockius LLP

(57) ABSTRACT

The present invention relates to coated cutting tool inserts particularly useful for heavy roughing turning operations of very large steel components, such as drive shafts for ships and shafts for wind power plants. The inserts are large with an iC, inscribed circle diameter, of greater than or equal to about 19 mm and a thickness of greater than or equal to about 6 mm with a composition of from about 5 to about 10 wt-% Co, from about 5 to about 12 wt-% cubic carbides or carbonitrides of the metals Ti, Ta and/or Nb, and balance WC with a stratified binder phase enriched surface zone from about 15 to about 40 μm thick. The inserts have an edge rounding before coating of 35-95 μm. The coating comprises

- a first, innermost layer of $TiC_xN_yO_z$ and a total thickness from about 0.1 to about 1.5 μm,
- a second layer of $TiC_xN_y$ with a thickness of from about 4.5 to about 9.5 μm with columnar grains,
- a third layer of $TiC_xN_yO_z$ with a thickness of from about 0.3 to about 1.5 μm,
- a fourth layer of a smooth $\alpha$-$Al_2O_3$ with a thickness of from about 4.5 to about 9.5 μm and,
- a from about 0.1 to about 2 μm thick colored top layer, preferably TiN or ZrN, on the clearance sides.

The invention also relates to the method of making such inserts and the use thereof for heavy roughing turning operations of very large steel components.

13 Claims, No Drawings

COATED CEMENTED CARBIDE INSERT PARTICULARLY USEFUL FOR HEAVY DUTY OPERATIONS

BACKGROUND OF THE INVENTION

The present invention relates to coated cemented carbide inserts with a binder phase enriched surface zone particularly useful for heavy roughing turning operations of very large steel components with improved edge security and wear resistance in combination with extremely good plastic deformation resistance.

For turning of steel materials, both stainless and normal steels, coated cemented carbide inserts are widely used, especially CVD-coated inserts with a binder phase enriched cemented carbide body.

Through the binder phase enriched surface zone, an extension of the application area is obtained. The far most commonly used type is a cemented carbide body with a from about 10 to about 30 μm thick surface zone that is essentially free from cubic phase and moderately enriched in binder phase. Examples are U.S. Pat. No. 4,277,283, U.S. Pat. No. 4,610,931, U.S. Pat. No. 4,830,283 and U.S. Pat. No. 5,106,674.

Another type of binder phase enriched cemented carbide inserts is the so called stratified type, which is accomplished using a powder with very carefully controlled carbon content and a sintering process with controlled cooling. This type has a surface zone from about 15 to about 45 μm thick, which is more strongly enriched in binder phase by several thin stratified layers of binder phase essentially parallel to the outer surface. In large scale production, the carbon control is difficult and the stratified binder phase enrichment is rarely used in practice.

EP-A-603143 discloses a cemented carbide with a binder phase enriched surface zone, said cemented carbide containing WC and cubic phases in a binder phase in which the binder phase enriched surface zone has an outer part essentially free of cubic phase and an inner part containing cubic phase and stratified binder phase layers. It is thus a combination of the abovementioned two types of binder phase enrichments.

Heavy duty machining operations to which the invention relates are characterized by the use of relatively high forces to shape workpieces both by non-cutting and cutting processes. Such operations include non-cutting shaping processes such as extruding, rolling, drawing and ironing and cutting processes such as punching, shearing, and broaching, as well as high force drilling, grinding, milling and turning processes. Characteristic of heavy duty machining operations, work done on the workpiece together with friction between the tool and workpiece generate sufficient heat to distort the workpiece and cause high rates of tool wear.

One example of a heavy duty application is heavy roughing turning operations of very large steel components such as drive shafts for ships and shafts for wind power plants which can be up to 20 m long and up to 1.5 m in diameter, where large cutting inserts are used with iC greater than or equal to about 19 mm, iC is the diameter of the inscribed circle of the insert, and a thickness of greater than or equal to about 6 mm. The demands on the cutting inserts are extremely high as the forged shafts often are oval and have forged skin and inclusions in the surface (oxide scale). With the ovality, the depth of cut (DOC) may be zero occasionally during the cutting operation. The steel type may be low alloyed or carbon steel, e.g., tough hardened steel. Furthermore, the cutting data is extreme with feed rates up to about 2.5 mm and depths of cut up to about 30 mm. This together puts very high demands on toughness behaviour, resistance to plastic deformation and wear resistance on the cutting tool insert.

OBJECTS AND SUMMARY OF THE INVENTION

It is an object of the present invention to provide a cutting tool insert particularly useful for heavy duty applications such as heavy roughing turning operations of very large steel components.

It is a further object of the present invention to provide a cutting tool insert with improved edge security, wear resistance in combination with extremely good plastic deformation resistance.

In one embodiment of the invention, there is provided a coated cutting tool insert comprising a cemented carbide insert body with a stratified binder phase enriched surface zone and a coating wherein the stratified binder phase enriched surface zone has a binder phase content having a maximum of from about 1.5 to about 4 times the nominal binder phase content and is from about 15 to about 45 μm thick whereby the stratified binder phase enriched surface zone as well as an about 100 to about 300 μm thick zone underneath it contain no free graphite, i.e., correspond to a C-porosity of C00 and with a C-porosity in the inner central part of the cemented carbide body of from about C06 to about C08, and the inserts are large with an iC, inscribed circle diameter, of greater than or equal to about 19 mm, and a thickness of greater than or equal to about 6 mm.

In another embodiment of the invention, there is provided a method of making a coated cutting tool insert comprising a cemented carbide insert body with a stratified binder phase enriched surface zone and a coating comprising providing a cemented carbide insert body with an inscribed circle diameter of greater than or equal to about 19 mm, and a thickness of greater than or equal to about 6 mm, with a carbon content corresponding to a C-porosity in the inner central part of the cemented carbide insert body of from about C06 to about C08, and a Hc-value of from about 9.0 to about 13.5, the stratified binder phase enriched surface zone is from about 15 to about 45 μm thick and the binder phase content of the binder phase enriched surface zone has a maximum of from about 1.5 to about 4 times the nominal binder phase content made by sintering a presintered or compacted body with, for formation of stratified layers, an optimum amount of carbon in an inert atmosphere or in vacuum, for about 15 to about 180 min at from about 1380 to about 1520° C., followed by slow cooling, from about 20 to about 100° C./h, through the solidification region, from about 1300 to about 1220° C.

In still another embodiment of the present invention, there is provided the use of the insert described above for heavy duty machining applications of very large components of steel, at a cutting speed in the range of from about 25 to about 100 m/min, feed rates in the range of from about 1 to about 2.5 mm and depth of cut from about 0 to about 30 mm, depth of cut=0 due the ovality of the work pieces.

DETAILED DESCRIPTION OF THE PREFERRED EMBODIMENTS

It has now surprisingly been found that cutting tool inserts showing improved properties with respect to the different demands prevailing at the above mentioned cutting operations can be obtained with cutting tool inserts comprising: a cemented carbide body with a stratified binder phase enriched surface zone partly depleted in cubic phase and with a well balanced carbon content giving a well defined content of free carbon, graphite, in the inner part of the cemented carbide body, preferably in combination with a columnar $TiC_xN_y$-layer and a post treated $\alpha$-$Al_2O_3$ top layer.

According to the present invention, a coated cutting tool insert is provided comprising a cemented carbide with a binder phase with a very low W-content and with a stratified binder phase enriched surface zone partly depleted in cubic phase and a coating preferably comprising a columnar $TiC_xN_y$-layer and a post treated $\alpha$-$Al_2O_3$ top layer. The inserts are large with an iC of greater than or equal to about 19 mm, preferably from about 30 to about 60 mm and a thickness of greater than or equal to about 6 mm, preferably from about 9 to about 20 mm.

The cemented carbide has a composition of from about 5 to about 10, preferably from about 5.5 to about 8, most preferably from about 6 to about 7, wt-% Co, from about 5 to about 12, preferably from about 7 to about 10, most preferably from about 8 to about 9, wt-% cubic carbides or carbonitrides of the metals from group IVA and VA, preferably Ti, Ta and Nb, and preferably with a Ti-content of from about 1.0 to about 4.0 wt-%, most preferably from about 1.5 to about 3.0 wt-%, and balance WC, preferably from about 80 to about 88 wt-% WC. The nitrogen content is less than about 0.1, preferably from about 0.02 to about 0.1, most preferably from about 0.04 to about 0.07, wt-% and the carbon content is adjusted to correspond to a C-porosity in the inner central part of the cemented carbide body of from about C06 to about C08, preferably about C08. The stratified binder phase enriched surface zone is from about 15 to about 45, preferably from about 20 to about 40, most preferably from about 25 to about 35, μm thick, preferably with an outer part essentially free from cubic phase. The thickness of this outer part is from about 25 to about 50, preferably from about 30 to about 45, % of the total thickness of the stratified binder phase enriched surface zone. The binder phase content of the binder phase enriched surface zone has a maximum of from about 1.5 to about 4, preferably from about 2 to about 3, times the nominal binder phase content. Further, the stratified binder phase enriched surface zone as well as an about from about 100 to about 300 μm thick zone underneath it contain no free graphite, i.e., corresponds to a C-porosity of C00. The Hc-value is from about 9 to about 13.5, preferably from about from about 10 to about 12, kA/m.

The cobalt binder phase is alloyed to a very low amount of tungsten (W). W in the binder phase influences the magnetic properties of cobalt and can hence be related to a value, CW-ratio, defined as $$\text{CW-ratio}=\text{magnetic-\% Co}/\text{wt-\% Co}$$

where magnetic-% Co is the weight percentage of magnetic Co and wt-% Co is the weight percentage of Co in the cemented carbide.

The CW-ratio can vary between 1 and about 0.75 dependent on the degree of alloying. A lower CW-ratio corresponds to a higher W content and a CW-ratio=1 corresponds practically to an absence of W in the binder phase.

According to the present invention, the improved cutting performance is enhanced if:

A) the cemented carbide has a CW-ratio of from about 0.96 to about 1.0, preferably within from about 0.98 to about 1.0, most preferably within from about 0.99 to about 1.0.

B) the cutting inserts have an edge rounding before coating of from about 35 to about 95, preferably from about from about 40 to about 60, μm.

C) the coating comprises:

a first, innermost layer of $TiC_xN_yO_z$ with x+y+z=1, y is equal to or greater than x and z less than about 0.2, preferably y greater than about 0.8 and z=0 and a total thickness from about 0.1 to about 1.5 μm, preferably greater than about 0.4 μm.

a second layer of $TiC_xN_y$ with x+y=1, x greater than about 0.3 and y greater than about 0.3, with a thickness of from about 4.5 to about 9.5 μm, preferably from about 5 to about 7.5 μm, with columnar grains.

a third layer of $TiC_xN_yO_z$ with x+y+z=1, x greater than about 0.3 and z greater than about 0.3, y greater than or equal to 0 and less than about 0.2, with a thickness of from about 0.3 to about 1.5 μm.

a fourth layer of a smooth $\alpha$-$Al_2O_3$ with a thickness of from about 4.5 to about 9.5 μm, preferably from about 5 to about 7.5 μm and a surface roughness in the cutting area zone of Ra less than about 0.4 μm over a length of 10 μm.

the ratio of layer thicknesses of the fourth layer of $Al_2O_3$ and the second layer of $TiC_xN_y$ is preferably from about 0.8 to about 1.2.

a from about 0.1 to about 2 μm thick colored top layer, preferably TiN or ZrN, on the clearance side.

The present invention also relates to a method of making coated cutting tool inserts having a cemented carbide body with a composition of from about 5 to about 10, preferably from about 5.5 to about 8, most preferably from about 6 to about 7 wt-% Co, from about 6 to about 11, preferably from about 7 to about 10, most preferably from about 8 to about 9 wt-% cubic carbides or carbonitrides of the metals from group IV and V, preferably Ti, Ta and Nb, and preferably with a Ti-content of from about 1 to about 4 wt-%, most preferably from about 1.5 to about 3 wt-%, and balance WC, preferably from about 80 to about 88 wt-% WC. The nitrogen content is less than about 0.1, preferably from about 0.02 to about 0.10, most preferably from about 0.04 to about 0.07, wt-% and the carbon content is adjusted to correspond to a C-porosity in the inner central part of the cemented carbide body of from about C06 to about C08, preferably about C08.

Production of cemented carbides according to the invention is most favorably done by sintering a presintered or compacted body containing nitrogen and, for formation of stratified layers, an optimum amount of carbon (which can be determined by the skilled artisan) in an inert atmosphere or in vacuum, for about 15 to about 180 min at from about 1380 to about 1520° C., followed by slow cooling, from about 20 to about 100° C./h, preferably from about 40 to about 70° C./h, through the solidification region, from about 1300 to about 1220° C., preferably from about 1290 to about 1240° C. The sintering conditions are adjusted to obtain an Hc-value in the range of from about 9 to about 13.5, preferably from about 10 to about 12, kA/m. The CW-ratio should be about 0.96-1, preferably within about 0.98-1, most preferably within about 0.99-1. The stratified binder phase enriched surface zone is from about 15 to about 45, preferably from about 20 to about 40, most preferably from about 25 to about 35, μm thick preferably with an outer part essentially free from cubic phase. The thickness of this outer part is from about 25 to about 50, preferably from about 30 to about 45, % of the total thickness of the stratified binder phase enriched surface zone. The binder phase content of the binder phase enriched surface zone has a maximum of from about 1.5 to about 4, preferably from about 2 to about 3, times the nominal binder phase content. Prior to the coating, the inserts are treated to an edge radius of from about 35 to about 95, preferably from about 40 to about 60, μm and surface cleaned using electrochemical or blasting methods.

The inserts are provided with a coating comprising:

a first, innermost layer of $TiC_xN_yO_z$ with x+y+z=1, y is equal to or greater than x and z less than about 0.2, preferably y greater than about 0.8 and z=0 and a total thickness from about 0.1 to about 1.5 μm, preferably greater than about 0.4 μm using known CVD-methods.

a second layer of $TiC_xN_y$ with x+y=1, x greater than about 0.3 and y greater than about 0.3, with a thickness of from about 4.5 to about 9.5 μm, preferably from about 5 to about 7.5 μm, with columnar grains using the MTCVD-technique with acetonitrile as the carbon and nitrogen source for forming the layer in the temperature range of from about 700 to about 900° C. The exact conditions, however, depend to a certain extent on the design of the equipment used and can be determined by the skilled artisan.

a third layer of $TiC_xN_yO_z$ with x+y+z=1, x greater than about 0.3 and z greater than about 0.3, y greater than or equal to 0 and less than about 0.2, with a thickness of from about 0.3 to about 1.5 μm using known CVD-methods.

a fourth layer of a smooth $\alpha$-$Al_2O_3$ with a thickness of from about 4.5 to about 9.5 μm, preferably from about 5 to about 7.5 μm, using known CVD-methods. Preferably, the ratio of layer thicknesses of the fourth layer of $Al_2O_3$ and the second layer of $TiC_xN_y$ is from about 0.8 to about 1.2.

a from about 0.1 to about 2 μm thick colored top layer, preferably TiN or ZrN. The top layer is present on the clearance side and is removed on the rake face by brushing or blasting to a surface roughness in the cutting area zone of Ra<0.4 μm over a length of 10 μm.

The present invention also relates to the use of cutting tool inserts as described above for heavy duty machining applications such as heavy roughing turning operations of very large components of steel, preferably of carbon steel or low alloyed steel, e.g., tough hardened steel, such as drive shafts for ships and shafts for wind power plants which can be as large as 20 m long and up to about 1.5 m in diameter using large cutting inserts with an iC of greater than or equal to about 19 mm, preferably from about 30 to about 60 mm and a thickness of greater than or equal to about 6 mm, preferably from about 9 to about 20 mm at a cutting speed of in the range of from about 25 to about 100, preferably from about 25 to about 75 m/min, feed rates in the range of from about 1 to about 2.5 mm and depth of cut from 0 to about 30 mm, depth of cut=0 due to the ovality of the work pieces, preferably from about 3 to about 30 mm.

The invention is additionally illustrated in connection with the following examples, which are to be considered as illustrative of the present invention. It should be understood, however, that the invention is not limited to the specific details of the examples.

Example 1

From a powder mixture with the composition 2.2 weight-% TiC, 0.5 weight-% TiCN, giving an N-content of 0.05 wt-%, 3.6 weight-% TaC, 2.4 weight-% NbC, 6.5 weight-% Co and rest WC with 0.25 weight-% overstoichiometric carbon content, turning inserts SCMT380932 with iC=38 mm and thickness=9.5 mm were pressed. The inserts were sintered in $H_2$ up to 450° C. for dewaxing and further in vacuum to 1350° C. and subsequently in a protective atmosphere of 40 mbar Ar for 1 h at 1450° C. The cooling was performed with a well controlled temperature decrease of 60° C./h within the temperature interval 1290 to 1240° C. in the same protective atmosphere. After that the cooling continued as normal furnace cooling with maintained protective atmosphere.

The sintered inserts had a binder phase enriched surface zone. The outer part of this surface zone was moderately binder phase enriched, essentially free of cubic phase and with a weakly developed statified binder phase structure, and had a thickness of 15 μm. Inside this outer part, there was a 20 μm thick zone containing cubic phase and with a strong cobalt enrichment as a stratified binder phase structure. The maximum cobalt-content in this part was 17 weight-% as an average over a distance of 100 μm parallel to the surface. The measurement was done using line scan in a micro-probe analyser equipped with wavelength dispersive spectrometer (WDS). Further below this part there was a zone about 150-200 μm thick with essentially nominal content of cubic phase and binder phase but without graphite. In the inner part of the insert graphite was present corresponding to a C-porosity of C08. The Hc-value was 11.5 and the CW-ratio was 0.99.

The inserts were edge rounded using a brushing method to a radius of 50 μm and surface cleaned by an electrochemical method and then coated with a first 0.5 μm thick $TiC_xN_y$-layer with a high nitrogen content corresponding to an x-value of about 0.05, followed by a second 8 μm thick $TiC_xN_y$-layer, with an x-value of about 0.55 and with a columnar grain structure using MTCVD-technique (temperature 850-885° C. and $CH_3CN$ as the carbon/nitrogen source). In subsequent steps during the same coating cycle a third 1 μm thick Ti(C, O)-layer was deposited followed by a fourth 7 μm thick layer of $\alpha$-$Al_2O_3$ and a 1 μm thick top layer of TiN.

The inserts were finally wet blasted on the rake face with alumina grit in order to remove the top TiN-layer and to produce a smooth surface finish of the exposed $Al_2O_3$-layer of Ra=0.2 μm over a length of 10 μm.

Example 2

Inserts from Example 1 were tested at a customer producing shafts for wind power plants and compared to commercially available inserts suitable for this type of operation and in the same insert style as in Example 1, see table 1 (prior art).

TABLE 1

| Variant | Substrate composition, wt-% #) | | | | Surface zone *) | | Coating thickness, |
|---|---|---|---|---|---|---|---|
| | Co | TaC | NbC | TiC | μm | CW-ratio | μm and type |
| Ref A | 7.5 | 2.9 | 0.5 | 2.3 | 26 | 0.88 | 8.0 $TiC_xN_y$, 7.0 $\alpha$-$Al_2O_3$ |
| Ref B | 10.0 | 5.6 | — | 2.9 | 20 | 0.82 | 6.5 $TiC_xN_y$, 5.0 $\kappa$-$Al_2O_3$ x = 0.55, y = 0.45 |

#) rest WC

*) binder phase enriched free from cubic phase, non-stratified

The inserts were tested in a heavy roughing longitudinal turning operation of a forged shaft with diameter 800 mm and 8 m in length in steel SS2244.

Cutting Data:

Cutting speed: 37 m/min

Feed rate: 1.8 mm/rev

Depth of cut: 4-30 mm (sometimes 0, due to ovality)

No coolant

The tool life of the insert according to invention (Example 1) was 115 min compared to 55 min and 38 min for ref A and ref B, respectively. The wear type was mainly flank wear for the insert according to the invention, plastic deformation and breakage for ref A, and plastic deformation for ref B.

From Example 2 it is evident that the insert according to the invention gives superior performance due a very good combination of edge toughness and plastic deformation resistance.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Coated cutting tool insert comprising a cemented carbide insert body with a stratified binder phase enriched surface zone and a coating wherein the stratified binder phase enriched surface zone has a binder phase content having a maximum of from about 1.5 to about 4 times the nominal binder phase content and is from about 15 to about 45 μm thick whereby the stratified binder phase enriched surface zone as well as an about 100 to about 300 μm thick zone underneath it containing no free graphite, which corresponds to a C-porosity of C00 and with a C-porosity in the inner central part of the cemented carbide body of from about C06 to about C08, the inserts are large with an iC, inscribed circle diameter, of greater than or equal to about 19 mm, and a thickness of greater than or equal to about 6 mm, and the inserts have edge rounding about 35 to about 95 μm.

2. Coated cutting tool insert of claim 1 wherein the stratified binder phase enriched surface zone has an outer part essentially free from cubic carbide phase with a thickness of from about 25 to about 50% of the total thickness of the binder phase enriched surface zone and the nitrogen content is from about 0.02 to about 0.10 wt-%.

3. Coated cutting tool insert of claim 1 wherein the cemented carbide has a CW-ratio of from about 0.96 to about 1.0.

4. Coated cutting tool insert of claim 1 wherein the cemented carbide has a composition of from about 5 to about 10 wt-% Co, from about 5 to about 12 wt-% cubic carbides or carbonitrides of the metals from groups IVb and Vb, and balance WC whereby the nitrogen content is less than about 0.1, the cemented carbide has an Hc-value of from about 9 to about 13.5 kA/m.

5. Coated cutting tool insert of claim 1 wherein the coating comprises a first, innermost layer of $TiC_xN_yO_z$ with x+y+z=1, y is equal to or greater than x and z less than about 0.2 and a total thickness from about 0.1 to about 1.5 μm, a second layer of $TiC_xN_y$ with x+y=1, x greater than about 0.3 and y greater than about 0.3, with a thickness of from about 4.5 to about 9.5 μm, with columnar grains, a third layer of $TiC_xN_yO_z$ with x+y+z=1, x greater than about 0.3 and z greater than about 0.3, y greater than or equal to 0 and less than about 0.2, with a thickness of from about 0.3 to about 1.5 μm, a fourth layer of a smooth $\alpha$-$Al_2O_3$ with a thickness of from about 4.5 to about 9.5 μm and a surface roughness in the cutting area zone of Ra<0.4 μm over a length of 10 and a from about 0.1 to about 2 μm thick colored top layer on the clearance sides.

6. The coated cutting tool insert of claim 1 wherein the stratified binder phase enriched surface zone has a maximum of from about 2 to about 3 times the nominal binder phase and is from about 20 to about 40 μm thick, with a C-porosity in the inner central part of the cemented carbide of about C08, the inserts have an iC from about 30 to about 60 mm and a thickness of from about 9 to about 20 mm.

7. The coated cutting tool of claim 2 wherein the stratified binder phase enriched surface zone has an outer part essentially free from cubic carbide phase with a thickness of from about 30 to about 45% of the total thickness of the binder phase enriched surface zone and the nitrogen content is from about 0.04 to about 0.07 wt-%.

8. The coated cutting tool of claim 3 wherein the cemented carbide has a CW-ratio of from about 0.98 to about 1.0.

9. The coated cutting tool of claim 8 wherein the cemented carbide has a CW-ratio of from about 0.99 to about 1.0.

10. The coated cutting tool of claim 4 wherein the cemented carbide has a composition of from about 5 to about 5.8 wt-% Co, from about 7 to about 10 wt-% cubic carbides or carbonitrides of Ti, Ta and Nb, the WC content is from about 80 to about 88 wt-%, the cemented carbide has an Hc value of from about 10 to about 12 kA/m and an edge rounding of from about 40 to about 60 μm.

11. The coated cutting tool of claim 10 wherein the cemented carbide has a Co content of from about 6.0 to about 7.0 wt-%, from about 8 to about 9 wt-% cubic carbides or carbonitrides and a Ti content of from about 1.0 to about 4.0 wt-%.

12. The coated cutting tool of claim 5 claim 10 wherein in the first, innermost layer y is greater than about 0.8 and z=0 with a total thickness greater than about 0.4 μm, said second layer of $TiC_xN_y$ has a thickness of from about 5 to about 7.5 μm, said fourth layer has a thickness of from about 5 to about 7.5 μm, the ratio of layer thicknesses of the fourth layer of $Al_2O_3$ and the second layer of $TiC_xN_y$ is from about 0.8 to about 1.2 and said top layer is TiN or ZrN.

13. Use of the cutting tool inserts of claim 1 for heavy duty machining applications of very large components of steel, at a cutting speed in the range of from about 25 to about 100 m/min feed rates in the range of from about 1 to about 2.5 mm and depth of cut from about 0 to about 30 mm, depth of cut=0 due the ovality of the work pieces.

* * * * *